US005228609A

United States Patent [19]

Gregory

[11] Patent Number: 5,228,609

[45] Date of Patent: Jul. 20, 1993

[54] FANNYPACK INCLUDING AN IMPROVED CONFORMAL WAISTBAND AND LUMBAR PAD

[75] Inventor: Wayne B. Gregory, Temecula, Calif.

[73] Assignee: Bianchi International, Temecula, Calif.

[21] Appl. No.: 930,780

[22] Filed: Aug. 17, 1992

[51] Int. Cl.[5] ..... A45F 3/02

[52] U.S. Cl. ..... 224/224; 224/208; 224/907

[58] Field of Search ..... 224/208, 224, 907, 204, 224/210, 211, 215, 216, 262

[56] References Cited

U.S. PATENT DOCUMENTS 4,420,103 12/1983 Douglass ..... 224/210
5,172,838 12/1992 Rowell et al. ..... 224/224

FOREIGN PATENT DOCUMENTS 2754061 6/1979 Fed. Rep. of Germany ..... 224/907

OTHER PUBLICATIONS

1991 Gregory Catalog, p. 15, Issued Dec. 1990.
Gregory Dealer's Workbook, p. 22, Issued Aug. 1991.

*Primary Examiner*—Renee S. Luebke
*Attorney, Agent, or Firm*—Wagner & Middlebrook

[57] ABSTRACT

A fannypack is disclosed which includes a back support section to which a carry bag is attached including a semi-rigid plate of polyethylene which extends from below to substantially above a wearer's lumbar region and which includes a lumbar pad including a series of spaced polyfoam members which are molded to a stretchable fabric cover. Attached to the back support section are a pair of waistband members which also include spaced polyfoam members molded to a stretchable fabric cover. Belt members attached to the back support section secure the waistband members around the wearer and are fastened at the front with a quick release buckle. Additional straps attached at the bottom and top of the carry bag and passing through loop members anchored outboard on the belt members may be pulled up to further secure the carry bag against the wearer.

15 Claims, 3 Drawing Sheets

FIG. 1
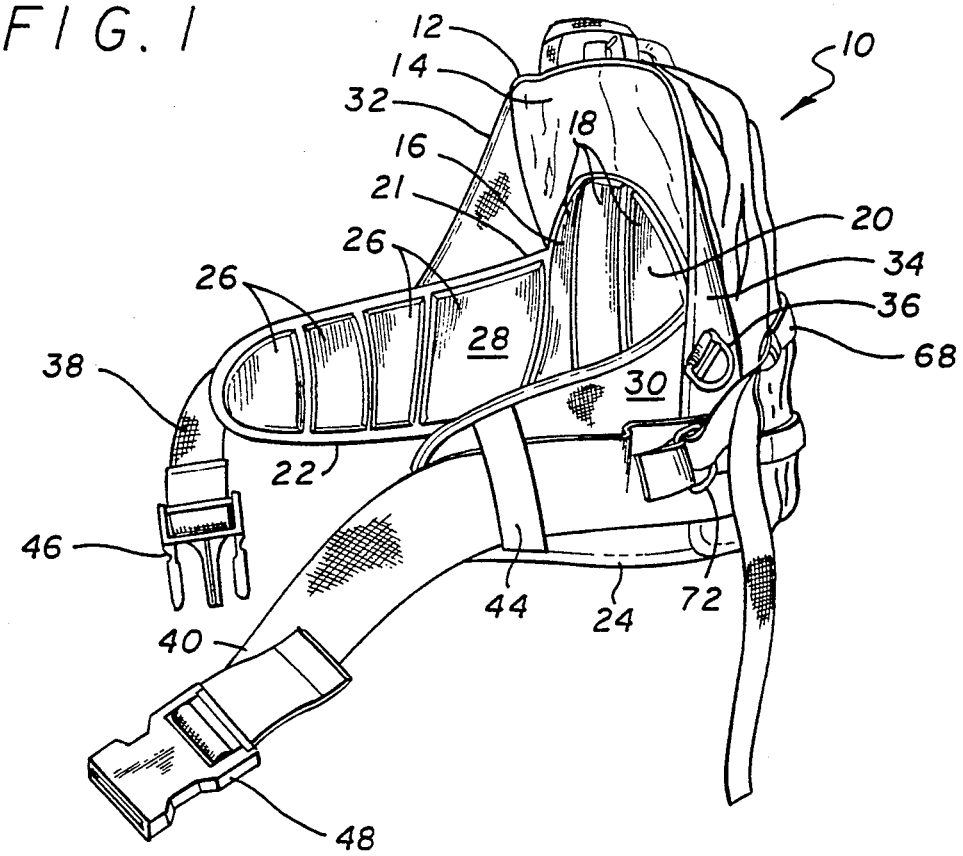
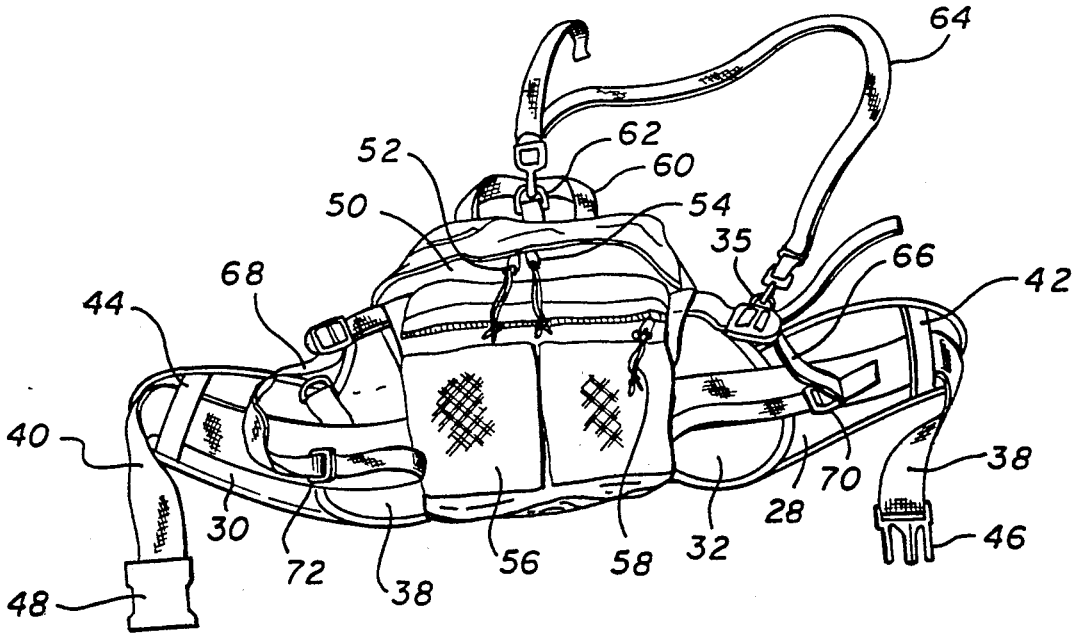
FIG. 2

FIG. 3
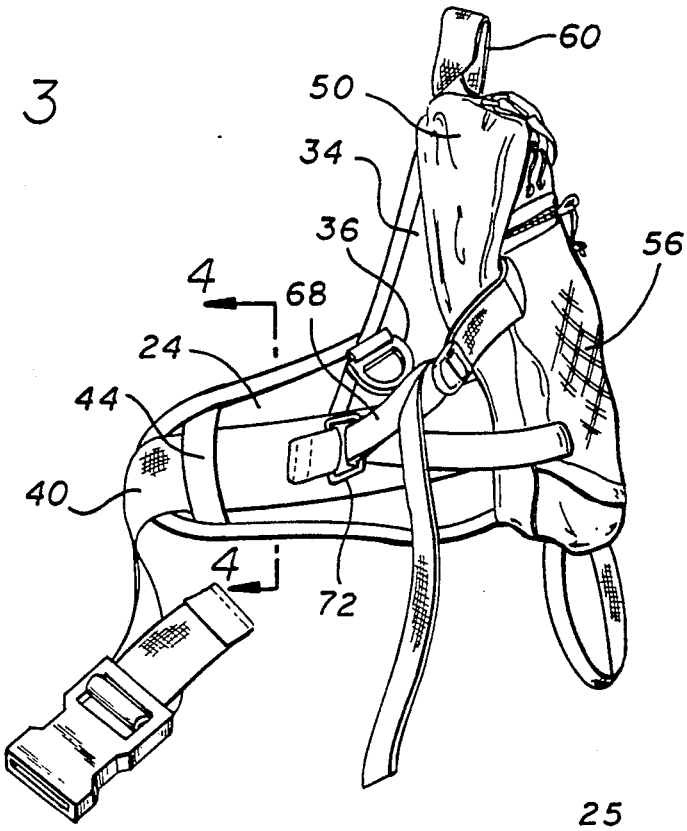
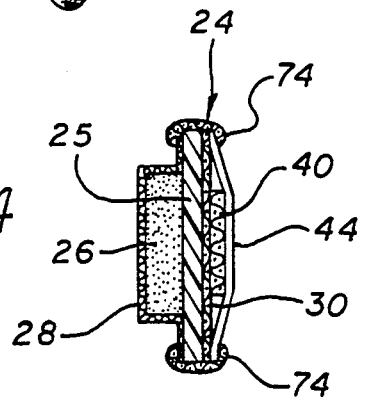
FIG. 4
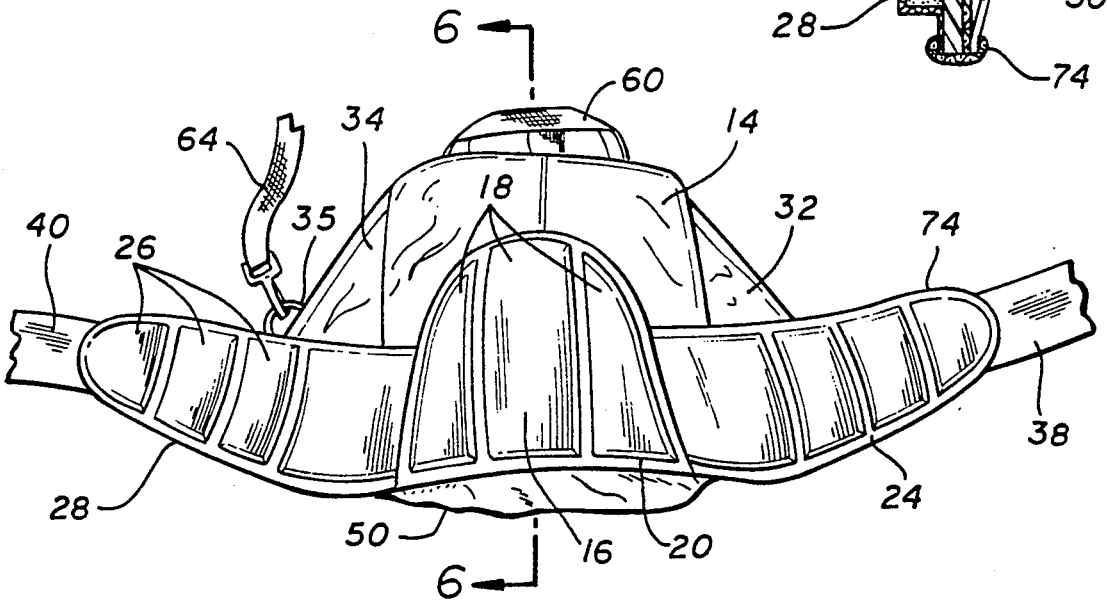
FIG. 5

FIG. 7
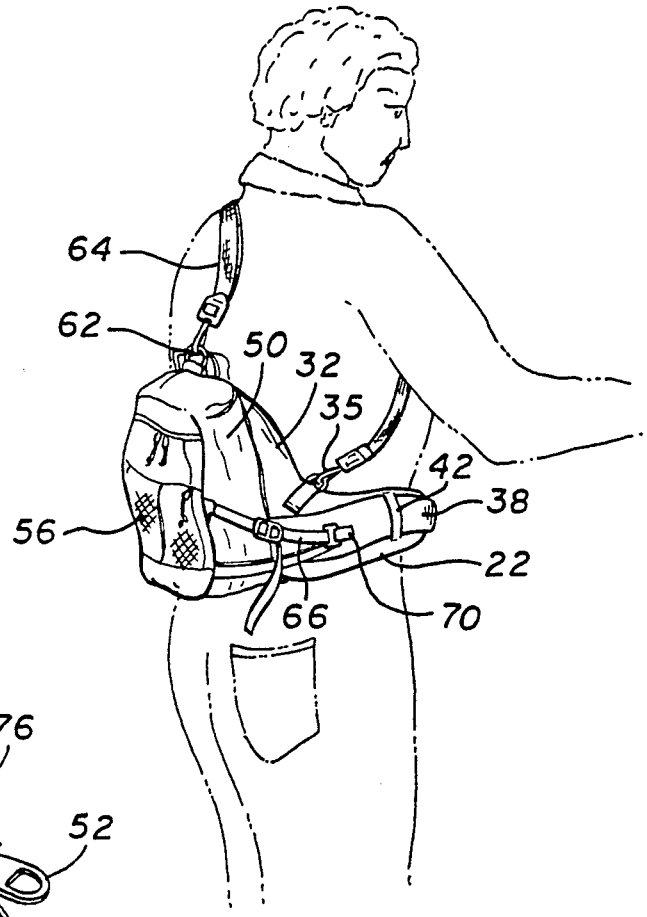
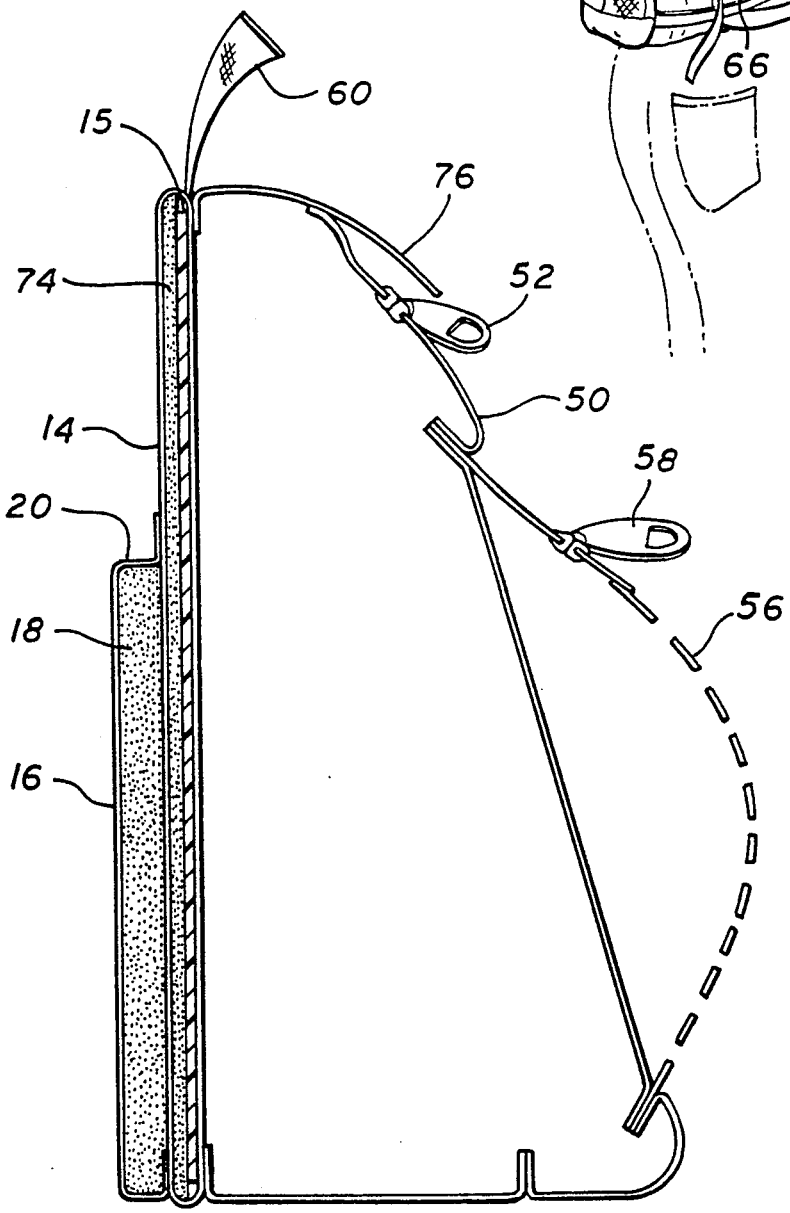
FIG. 6

FANNYPACK INCLUDING AN IMPROVED CONFORMAL WAISTBAND AND LUMBAR PAD

BACKGROUND OF THE INVENTION

In the field of manufacturing of backpacks and related products, certain specific types of packs have evolved. Possibly the greatest amount of effort has been expended in the design and development of full scale backpacks for loads of 40–50 lbs or more which frequently include an aluminum frame extending from waist to shoulders to which a carry pack is attached, a heavy waistband which may be heavily padded since most of the load is carried on the hips, and other straps extending from the top of the frame across the sternum and/or around the shoulders. Heavy padding of the waistband has not always proved successful since the cover material may tend to bunch up and wrinkle causing unpleasant pressure points.

For shorter excursions, usually not exceeding one day, or for carrying of one's belongings in the absence of pockets or handbags, various types of fannypacks have been devised. Some of such fannypacks have a very limited capacity and are designed to hold only a few small items such as might be carried in a small handbag. Others have been designed to carry quite substantial loads which might weigh in the neighborhood of 10–15 lbs. or more. Such loads are sufficiently heavy that they are frequently carried in shoulder packs having straps around the shoulders and which are not supported at the waist or hips. For hiking substantial distances, however, it has been found that carrying such weights on one's hips is preferable and a selection of fannypacks is available which are primarily supported on the hips with a fairly heavy webbed belt at the waist. Because it is generally believed that the weights carried in such fannypacks are limited and the duration of use is also limited, many such fannypacks are constructed of relatively lightweight materials and include limited or no padding. Such packs are designed to sell at relatively low prices. It is believed, however, that there is a need for a high quality fannypack which is durable and which includes significant padding and lumbar support such that moderately heavy loads can be carried comfortably for several hours at a time.

SUMMARY OF THE INVENTION

The fannypack of the present invention includes a back support section including a polyethylene plate which extends vertically from below to substantially above a wearer's lumbar region and is covered with a durable nylon fabric. Attached thereto are the carry pack and a lumbar pad including a plurality of elongated polyfoam members which are horizontally spaced from each other and are covered with a synthetic stretch fabric, the pad being thermally molded to retain the polyfoam members in place and defining a plurality of vertical folds in the fabric layer between the pads. This avoids wrinkling of the fabric as the lumbar pad bends around the wearer.

Attached to each side of the back support section are waistband members each of which includes a polyethylene backing plate with a plurality of polyfoam pads attached thereto and horizontally spaced from each other. A heavy fabric is placed on the outside of the backing plate and a durable two way stretch fabric covers the pads and the backing plate. The stretch fabric, and polyfoam pads, are thermally molded together which retains the pads in place, defining a plurality of vertical folds in the fabric layer which avoids producing wrinkling of the fabric when the waistband is curved around the wearer's body. Wide belt members are fastened to the back support section and extend through external loops on the waistband members terminating with fasteners such as quick release buckles securing the fannypack around the wearer's waist.

Additional generally triangular members of strong fabric material are fastened to each side of the fabric covering the back support plate and to the load carrying bag. Each is also attached to the bottom of one of the waistband members and to one of the belt members. If desired an additional strap may be secured between the top of the back support section and an outside edge of one of the triangular fabric members to distribute some of the load to a wearer's shoulder.

BRIEF DESCRIPTION OF THE DRAWINGS

FIG. 1 is a perspective view of a fannypack according to the invention;

FIG. 2 is a rear elevation of the fannypack of FIG. 1;

FIG. 3 is a side view of the fannypack of FIGS. 1 and 2;

FIG. 4 is a sectional view taken along lines 4—4 of FIG. 3;

FIG. 5 is a front elevational view of the fannypack of FIG. 1;

FIG. 6 is a sectional view taken along lines 6—6 of FIG. 5;

FIG. 7 is a view of the fannypack of FIGS. 1–6 as worn on an individual.

DESCRIPTION OF THE PREFERRED EMBODIMENT

Referring now to FIGS. 1 and 2, the fannypack 10 includes a back support section 12 including a tough cover 14 of synthetic fabric placed over a semi-rigid polyethylene plate 15 (see FIG. 6) which extends below and a substantial distance above the wearer's waist. A lumbar pad 16 which includes a plurality of horizontally spaced elongated polyfoam members 18 and a cover 20 of stretchable fabric is thermally molded together and stitched to the cover 14 through a heavy binding 21. Lumbar pad 16 is formed with the members 18 spaced to provide vertical folds which prevent wrinkling and bunching of the cover 20 as the pad 16 is pulled tight against the wearer.

Attached to the back support section 12 and more particularly to the cover 14 are a pair of waistband members 22 and 24 each of which includes a semi-rigid plate 25 of polyethylene material (see FIG. 4) to which is attached a plurality of horizontally spaced polyfoam members 26. The semi-rigid plates and polyfoam members 26 are covered with a stretch fabric 28 of synthetic material and the side of the plates opposite the members 26 is covered with a durable synthetic fabric 30, polyfoam members 26 and stretch fabric 28 being thermally molded together. This secures polyfoam members 26 in place leaving vertical folds which prevent wrinkling of the stretch fabric 28 when the waistband members 22 and 24 are pulled around a wearer's waist. A binding is stitched around the edges of the waistband members 22 and 24.

Either formed as part of the cover 14 or as separate members stitched to the cover are triangular fabric members 32 and 34 which are also attached to the bottom edges of waistband members 22 and 24, respectively. A D-ring 36 is attached to or near the upper edge of member 34 and a similar D-ring 35 may be similarly fastened to member 32.

Fastened to the back of cover 14 are a pair of belt members 38 and 40 of heavy webbing which pass through belt loops 42 and 44 on the outside of the waistband members 22 and 24. These belt members are attached to 2" quick release buckle fasteners 46 and 48 which enable the fannypack to be tightly fastened around a wearer's waist.

In FIG. 2 are seen the main carry bag 50 including slide fasteners 52 and 54 for opening and closing it as well as a smaller bag 56 attached to bag 50, bag 56 having a mesh cover for enabling its contents to be exposed to the air, as for drying. Bag 56 is accessed by means of a slide fastener 58. A handle 60 of fabric material is stitched to the top of cover 14. Attached to a loop 62 at the top of cover 14 and to fastener 35 is a "messenger strap" 64 which is used to distribute part of the load to the wearer's shoulder, if desired. Additional straps 66 and 68 are attached near the bottom and the top of bag 50 and are attached to loop members 70 and 72, respectively, anchored a distance outboard along belt members 38 and 40. Straps 66 and 68 provide a means for pulling the top part of bag 50 more closely to the body of the wearer.

FIG. 3 is a side view of the fannypack of FIGS. 1 and 2 showing the carry pack 50 and the mesh bag 56 attached thereto. The triangular member 34 is shown attached to bag 50. The waistband member 24 is shown attached to carry bag 50 as is the wide belt member 40 which is shown passing through belt loop 44. Strap 68 is shown anchored at the top and bottom of bag 50 and passing through loop member 72 which is anchored to an outboard position along belt member 40.

FIG. 4 is a sectional view taken along line 4—4 of FIG. 3. It shows the components of waistband member 24 including the polyethylene plate 25, one of the polyfoam member 26 with the stretchable fabric cover 28, the heavy fabric outside cover 30 and the belt loop 44 which is secured to the outside of waistband member 24 by means of a heavy binding 74 which encircles member 24 except for its inner attachment to back support section 12 where it is secured by stitching through the heavy binding 16. It will be recognized that the thicknesses of several of these members is somewhat exaggerated for clarity since most of the fabric members are only a few thousandths of an inch thick.

The fannypack as seen from the front or inside with most of the straps deleted, appears on FIG. 5 in which the cover 14, the lumbar pad 20, and the waistband members 24 and 28 are shown as well as the bottom of carry bag 50, the fabric handle 60, D-ring 35, a portion of messenger strap 64 and portions of belt members 38 and 40. In this view it will be observed that the separate polyfoam members 18 and 26 are clearly separated with vertical folds between them in the covering fabric which prevents wrinkling and bunching of the covering fabric.

FIG. 6 is a sectional view taken along line 6—6 of FIG. 5. In this view the semirigid polyethylene plate 15 is shown with a thin layer of polyfoam padding 74 on the side nearest the wearer, both of which are covered by the tough cover 14 of synthetic fabric such as nylon. Stitched to the cover 14 is the main carry bag 50 which has an opening operated by slide fastener 52. A cap 76 formed at the top of bag 50 covers the opening to prevent entry of moisture from rain or snow. Secured to the back of bag 50 is smaller bag 56 which has a mesh cover and which is opened and closed by means of a slide fastener 58.

Also fastened to cover 14 is the lumbar pad 16 including the polyfoam members 18, one of which is shown, and the cover 20 of stretchable fabric. The handle 60 is also fastened to cover 14, a part of which is shown.

FIG. 7 shows the fanny pack of the invention as worn by an individual. In this view the main carry bag 50 is shown as well as the smaller bag 56. Waistband member 22 extends around the wearer's right side and includes belt loop 42 carrying belt member 38. The triangular member 32 is shown with the D-ring 35. The messenger strap 64 is shown carried over the wearer's shoulder and fastened between D-ring 35 and similar fastener 62 at the top of the bag 50. The strap 66 and loop member 70 are also shown.

The above described embodiment of the present invention is merely descriptive of its principles and is not to be considered limiting. The scope of the present invention instead shall be determined from the scope of the following claims including their equivalents.

I claim:

1. A fannypack including a load carrying bag, means for opening and closing said bag, and fastening means for fastening said fannypack around a wearer's waist;

characterized in that said fannypack comprises a back support section including a polyethylene plate of such height as to extend below and a distance above the wearer's lumbar region, a fabric cover covering said polyethylene plate, said load carrying bag fastened to said fabric cover, a lumbar pad including a plurality of elongated polyfoam members spaced from each other, and a cover of stretchable fabric material molded to said polyfoam members and fastened to said fabric cover;

a pair of waistband members secured to said back support section, each of which includes a polyethylene backing plate, a plurality of polyfoam members fastened to said backing plate, a cover of stretchable fabric covering said polyfoam pads and molded thereto and a heavy fabric covering the opposite side of said backing plate from said polyfoam pads;

generally triangular members of strong fabric each of which is fastened to one side of said back support section and to one of said waistband members; and said polyfoam members and said elongated polyfoam members being spaced horizontally to define vertical fold areas to avoid wrinkling and/or bunching of the stretchable fabric cover material in said lumbar pad and said waistband members.

2. A fannypack as claimed in claim 1 wherein a strap is connected between the top center of said back support section and a top edge of one of said triangular members to provide means for partially supporting said bag on a wearer's shoulder.

3. A fannypack as claimed in claim 1 wherein a heavy binding is stitched around the periphery of said lumbar pad securing said lumbar pad to the fabric cover of said back support section.

4. A fannypack as claimed in claim 3 wherein said waistband members are stitched to said fabric cover through said heavy binding.

5. A fannypack as claimed in claim 3 wherein a heavy fabric binding is stitched around each of said waistband members.

6. A fannypack as claimed in claim 1 wherein said waistband members include belt loops and said fastening means includes strap means attached to said back support section and carried in said belt loops.

7. A fannypack including a load carrying bag, means for opening and closing said bag and a belt including a fastener for fastening said fannypack around a wearer's waist;

said fannypack including a back support section including a semirigid plate; a fabric cover covering said plate and fastened to said load carrying bag, a lumbar pad fastened to said fabric cover including a plurality of elongated polyfoam members spaced from each other, a cover of stretchable fabric material molded to said polyfoam members;

a pair of waistband members secured to said back support section each including a backing plate of semirigid material, a plurality of polyfoam pads fastened to said backing plate, a cover of stretchable material covering said polyfoam pads and molded thereto and heavy fabric material covering the opposite side of said backing plate from said polyfoam pads;

generally triangular members of strong fabric each of which is fastened to one side of said back support section and to one of said waistband members;

said polyfoam pads and said elongated polyfoam pads being spaced horizontally to define vertical fold areas to avoid wrinkling or bunching of said stretchable fabric covers.

8. A fannypack as claimed in claim 7 wherein a strap is connected between the top center of said back support section and a top edge of one of said triangular members to provide means for partially supporting said bag on a wearer's shoulder.

9. A fannypack as claimed in claim 7 wherein said backing plates are of polyethylene material and said polyfoam pads and said stretchable fabric covers are thermally molded together.

10. A fannypack as claimed in claim 7 wherein a heavy binding is stitched around the periphery of said lumbar pad securing said lumbar pad to the fabric cover of said back support section.

11. A fannypack as claimed in claim 10 wherein a heavy fabric binding is stitched around each of said waistband members.

12. A fannypack including a load carrying bag, means for opening and closing said bag and a belt including a fastener for fastening said fannypack around a wearer's waist;

characterized in that said fanny pack comprises a back support section including stiffening means of such height as to extend below and a distance above a wearer's lumbar region, a fabric cover covering said stiffening means, said load carrying bag fastened to said fabric cover, a lumbar pad including polyfoam members and a stretchable fabric cover stitched to said fabric cover;

a pair of waistband members secured to said back support section, each of which includes other stiffening means, a plurality of polyfoam pads, a cover of stretchable fabric covering said polyfoam pads and a heavy fabric covering the opposite side of said plate from said polyfoam pads, said stretchable cover and said polyfoam pads being molded together;

said polyfoam members being spaced horizontally to define vertical fold areas to avoid wrinkling and/or bunching of the stretchable fabric cover in said lumbar pad and said waistband members.

13. A fannypack as claimed in claim 12 wherein said waistband members include belt loops and said belt is fastened to said back support section and is carried in said belt loops.

14. A fannypack as claimed in claim 12 wherein a heavy binding is stitched to said lumbar pad, said fabric cover, and said waistband members to secure said lumbar pad and said waistband members to said fabric cover.

15. A fannypack as claimed in claim 12 wherein said waistband members are stitched to said fabric cover through said heavy binding.

* * * * *